US008052038B2

(12) United States Patent
Jackson

(10) Patent No.: US 8,052,038 B2
(45) Date of Patent: Nov. 8, 2011

(54) DISPENSING CONTAINER

(76) Inventor: Francis G. Jackson, Hudsonville, MI (US)

( * ) Notice: Subject to any disclaimer, the term of this patent is extended or adjusted under 35 U.S.C. 154(b) by 147 days.

(21) Appl. No.: 12/437,884

(22) Filed: May 8, 2009

(65) Prior Publication Data

US 2010/0282829 A1 Nov. 11, 2010

(51) Int. Cl.
*B65D 5/74* (2006.01)
*B65D 5/02* (2006.01)

(52) U.S. Cl. ..... 229/125.42; 229/123; 229/149

(58) Field of Classification Search ..... 229/123, 229/125.42, 141, 149, 152, 154, 404
See application file for complete search history.

(56) References Cited

U.S. PATENT DOCUMENTS

| | | | | |
|---|---|---|---|---|
| 1,433,439 | A * | 10/1922 | Weis | 229/149 |
| 2,333,260 | A | 11/1943 | Lundius | |
| 2,475,677 | A | 7/1949 | Ringler | |
| 3,083,890 | A * | 4/1963 | Ignell | 229/125.37 |
| 3,172,594 | A * | 3/1965 | Kuchenbecker | 229/217 |
| 3,262,627 | A | 7/1966 | Kersh et al. | |
| 3,269,644 | A * | 8/1966 | Bump | 229/248 |
| 3,279,228 | A * | 10/1966 | Brower | 72/56 |
| 4,457,431 | A | 7/1984 | Lundquist et al. | |
| 5,135,463 | A | 8/1992 | Hyduk | |
| 6,206,279 | B1 * | 3/2001 | Countee | 229/117.27 |
| 2004/0007596 | A1 | 1/2004 | Laverdure | |

FOREIGN PATENT DOCUMENTS

KR 20-1998-0058592 U 10/1998

OTHER PUBLICATIONS

International Search Report completed Dec. 27, 2010, from corresponding PCT Application No. PCT/US2010/034060.
Written Opinion of the International Searching Authority for International Application No. PCT/US2010/034060.

* cited by examiner

*Primary Examiner* — Gary Elkins
(74) *Attorney, Agent, or Firm* — Gardner, Linn, Burkhart & Flory, LLP

(57) ABSTRACT

A dispensing container for selectively holding and dispensing products has a resiliently deformable main panel with a centrally disposed pivot emboss extending longitudinally there along. One end of the pivot emboss terminates at a pivot panel located on the main panel. The container includes a spout panel positioned distally from the pivot panel with spout panel being at least partially selectively opened by deformation of the main panel along the pivot emboss. Deformation of the main panel may be imparted by inward squeezing motion to the sides of the container, which in turn causes the main panel to outwardly deform along the pivot emboss, resulting in opening of the spout.

20 Claims, 12 Drawing Sheets

DISPENSING CONTAINER

BACKGROUND OF THE INVENTION

The present invention is directed to a container, and in particular to a dispensing container that includes an integrated spout to facilitate selective opening.

Containers are known for use with a wide array of consumer products, including dry goods, liquids, and medicines. A common approach to sealing such containers is by use of a screw cap structure. Another known approach to sealing such structures without the use of a screw cap is by way of a gable top carton, such as has been commonly used for liquid dairy product cartons.

Screw top containers may be difficult for some individuals to open, such as those with reduced hand strength. Screw top containers also typically utilize a plastic cap system that is not environmentally friendly. Gable top cartons may also be difficult for some individuals to open, particularly when the carton is being opened for the first time. Moreover, the gable top construction creates a less efficient packing volume structure, which in turn impacts the storage, shipping, and stocking of products contained therein.

SUMMARY OF THE INVENTION

The present invention provides a container for various types of products that is easily opened and which may be formed from a single blank sheet of packaging material that is subsequently folded into the container shape to include an integrated opening or spout. The integrated spout of the container facilitates easy opening while providing a uniformly shaped product container.

According to an aspect of the present invention, a dispensing container for selectively holding and dispensing products comprises a resiliently deformable main panel having a centrally disposed pivot emboss extending longitudinally there along. The main panel also includes a pivot panel with one end of the pivot emboss terminating at the pivot panel. The container also includes a spout panel positioned distally from the pivot panel with the spout panel being at least partially selectively opened by deformation of the main panel along the pivot emboss. The pivot panel may be defined by a pair of pivot panel embosses extending from the pivot emboss and the container may include six sides, with the main panel defining one of the six sides and each said side being orthogonal to four adjacent sides.

In particular embodiments the container includes a pair of side panels and the main panel is substantially planar when the dispensing container is closed. The main panel is connected with and positioned between the side panels with the side panels extending substantially orthogonally relative to the main panel and longitudinally relative to the pivot emboss. The spout panel is at least partially opened by inward deformation of the side panels imparting deformation to the main panel along the pivot emboss. In such embodiments the main panel may be formed as a vertically oriented front panel and the side panels comprise a left side panel and a right side panel.

The container may also include one or more trigger panels adjacent the spout panel, with the trigger panel being defined by a plurality of trigger embosses on the main panel. Inward deformation of the trigger panels thereby imparts deformation to the main panel along the pivot emboss to open the spout panel. In this embodiment the spout panel may be substantially planar with the main panel when the container is closed with inward deformation of a trigger panel causing the spout panel to outwardly extend relative to the main panel.

A closing side of the container may be adjacent and orthogonal to the main panel with the spout panel connected to the main panel. In a variation of this embodiment the spout panel may include a main flap and a tuck flap with the closing side including a locking tab flap and the main flap being substantially planar with the main panel when the container is closed. The tuck flap is received by the locking tab flap when the container is closed and is displaced from the locking tab flap by deformation of the main panel along the pivot emboss. The main flap may be orthogonal to the main panel when the container is closed whereby the main flap defines at least a portion of the closing side. The closing side may alternatively include a closure panel with the tuck flap being retained by the closure panel when the container is closed.

In other embodiments the container may include a pair of side panels and a resiliently deformable back panel, with the back panel including a centrally disposed second pivot emboss extending longitudinally along the back panel. The back panel may also include a second pivot panel with one end of the second pivot emboss terminating at the second pivot panel. The spout panel in such an embodiment may include a main flap and a tuck flap with the main flap being connected to the main panel and the tuck flap retained on the back panel when the container is closed. The tuck flap being displaced from the back panel by deformation of the back panel along the second pivot emboss.

According to another aspect of the present invention, a dispensing container for selectively holding and dispensing products comprises a resiliently deformable main panel having a centrally disposed pivot emboss extending longitudinally along the main panel with the main panel being substantially planar and vertically oriented when the dispensing container is closed. The container further includes a pair of side panels connected to and extending substantially orthogonally from the main panel and longitudinally relative to the pivot emboss. A top side is adjacent and orthogonal to the main panel and side panels. A spout panel of the container is at least partially selectively opened by inward deformation of the side panels imparting deformation to the main panel along the pivot emboss. The main panel may include a pivot panel with one end of the pivot emboss terminating at the pivot panel.

In particular embodiments such container, the spout panel includes a main flap and a tuck flap and the top side includes a locking tab flap. The main flap being substantially planar with the main panel when the container is closed and the tuck flap being received by the locking tab flap when the container is closed, and with the tuck flap being displaced from the locking tab flap by deformation of the main panel along the pivot emboss.

The container may further include at least two trigger panels adjacent the spout panel formed by a plurality of trigger embosses, with inward deformation of the trigger panels causing the spout panel to fully open. The spout panel may also include a main flap and a tuck flap with the main flap being orthogonal to the main panel when the container is closed whereby the main flap defines at least a portion of the top side. The top side may include a closure panel with the tuck flap being retained by the closure panel when the container is closed.

The spout panel may include a main flap and a tuck flap, with the tuck flap being retained on a back panel of the container when closed and the tuck flap being displaced from the main panel by inward deformation of the side panels.

The present invention provides a uniformly shaped container with integrated spouts that are easily opened, such as by squeezing the sides of the container to cause the spout to open and/or inwardly pressing on one or more trigger panels to cause the spout to open or fully open. The container may be formed from a single blank sheet of packaging-material that is subsequently folded into the container shape to include the integrated opening or spout. The container may be used with dry goods, such as cereals, coffee and other food products, as well as powdered soaps and medicines. The container may also be used to hold and dispense liquid products, such as milk.

These and other objects, advantages, purposes and features of this invention will become apparent upon review of the following specification in conjunction with the drawings.

DESCRIPTION OF THE PREFERRED EMBODIMENTS

The present invention will now be described with reference to the accompanying figures, wherein the numbered elements in the following written description correspond to like-numbered elements in the figures.

Figure 5:
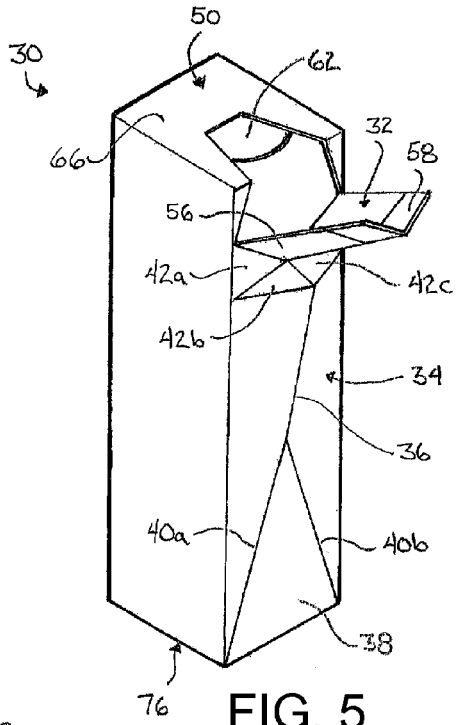
FIG. 5 is a front right side perspective view of the container of FIG. 2 shown with the spout fully opened.

FIGS. 1-5 illustrate an assembled container 30 in accordance with the present invention, with container 30 including an integrated spout 32 that is shown in various positions between being fully closed (FIGS. 1 and 2), to initially opening (FIG. 3), opened further (FIG. 4), and finally fully opened (FIG. 5). Container 30 includes a front or main panel 34, which in the illustrated embodiment is a vertically oriented panel having a longitudinally extending pivot emboss 36 with pivot emboss 36 extending along spout 32. Also included on main panel 34 is an inversion panel or pivot panel 38 formed by a pair of panel embosses 40*a*, 40*b* extending outwardly and downwardly from one end of pivot emboss 36 to respective corners of main panel 34. Main panel 34 also includes multiple trigger panels 42 formed by trigger embosses 44.

Figure 4:
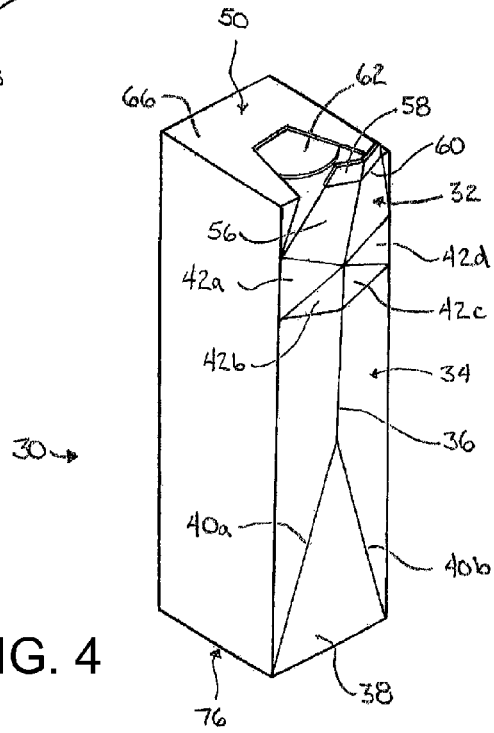
FIG. 4 is a front right side perspective view of the container of FIG. 2 shown with the spout opened further relative to FIG. 3.

As described more fully below, opening of spout 32 is initiated by inward deformation of the side panels 46, 48 of container 30, which causes main panel 34 to outwardly deform along pivot emboss 36 to both release spout 32 from top side 50 (FIG. 3) and straighten spout 32 (FIG. 4). Thereafter, inward deformation of trigger panels 42 causes spout 32 to fully extend into a fully open position (FIG. 5). Thus, container 30 provides a structure having a conveniently opening integrated spout 32 for containing and dispensing various products.

Figure 6:
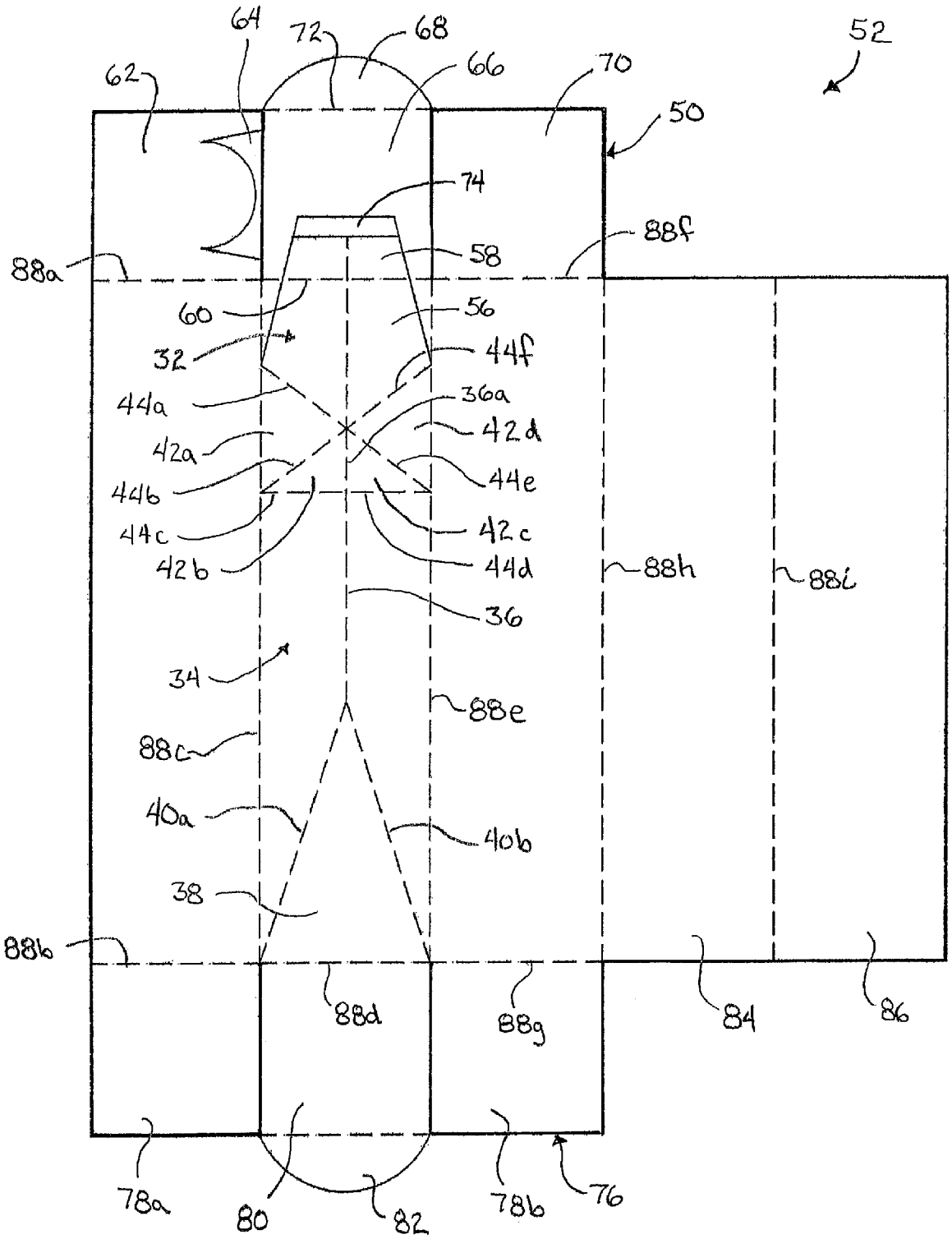
FIG. 6 is a top plan view of a stamped blank used to form the container of FIGS. 1-5.

FIG. 6 illustrates a stamped blank 52 that is subsequently folded into container 30 of FIGS. 1-5 and held in position by adhesive and various tuck panels. Blank 52 is conventionally formed by a stamping process in which blank 52 is cut out from a larger piece of material and the various emboss lines are created. For ease of understanding, blank 52 of FIG. 6 illustrates the various emboss lines as dashes and the cutouts or cuts as solid lines. The embossing on blank is used to both establish the edge fold lines demarking the panels and flaps of container 30, but also to create the various pivot lines which act as hinges for biasing and defining the opening of spout 32. As shown, blank 52 is a unitary piece of material that may be formed from flexible materials such as a coated paper material, such as a waxed material, plastics, or the like.

Spout or spout panel 32 of container 30 includes a main flap 56 and a tuck flap 58, with tuck flap 58 being defined by spout fold emboss 60 that is intersected by pivot emboss 36 that extends along spout panel 32. When container 30 is closed (FIG. 2), main flap 56 is substantially planar with main panel 34, and tuck flap 58 is positioned orthogonal to main panel 34 by being folded along spout fold emboss 60 such that it is planar to top side 50 and retained by locking tab flap 62 within locking tab cutout 64.

In the illustrated embodiment of FIGS. 1-6, main panel 34 includes multiple trigger panels 42*a*-42*d* defined by trigger embosses 44*a*-44*f*. As shown, trigger panel 42*a* is defined by trigger embosses 44*a* and 44*b*, and edge fold emboss 88*c*. Trigger panel 42*b* is defined by trigger embosses 44*b* and 44*c*, as well as by segment 36*a* of pivot emboss 36. Trigger panel 42*c* is defined by trigger embosses 44*d* and 44*e*, as well as by pivot emboss segment 36*a*. Finally, trigger panel 42*d* is defined by trigger embosses 44*e* and 44*f*, as well as by edge fold emboss 88*e*.

With reference to FIGS. 1-6, container 30 includes various panels and flaps in addition to those previously noted. Container 30 includes a top side or closing side 50, which is formed by several flaps or panels including locking tab flap 62, a top closure panel 66, and a dust flap 70. As understood from FIG. 6, locking tab flap 62 includes locking tab cutout 64, and top closure panel 66 includes a top tuck panel 68 defined by top tuck emboss 72. FIG. 6 also illustrates spout cutout 74, which forms an opening or gap between tuck flap 58 and top closure panel 66.

With reference to FIG. 6, container 30 further includes a bottom side 76, which is formed from a pair of dust flaps 78*a*, 78*b* and a bottom closure panel 80, with bottom closure panel 80 including a bottom tuck panel 82. Also included are a rear panel 84 and a glue flap 86. FIG. 6 further illustrates various edge fold embosses 88*a*-88*i*.

Container 30 is formed from blank 52 by folding blank 52 along the various edge fold embosses 88*a*-88*i*, with glue flap 86 being adhered to the inside of left side panel 46. Bottom side 76 is formed by conventional overlapping engagement of dust flaps 78*a*, 78*b*, which are in turn covered by bottom closure panel 80 with bottom tuck panel 82 then inserted behind the interior side of rear panel 84. Top side 50 is formed by overlapping locking tab flap 62 above dust flap 70, and in turn overlapping top closure panel 66 over locking tab flap 76 and inserting top tuck panel 68 behind the interior side of rear panel 84. Additional adhesives may be used, including at bottom side 76 and top side 50, depending upon the intended product to be contained within container 30. For example, adhesives may be used to produce a sealed container 30 such that container 30 may hold liquids or fine dry goods, such as powders.

Figure 1:
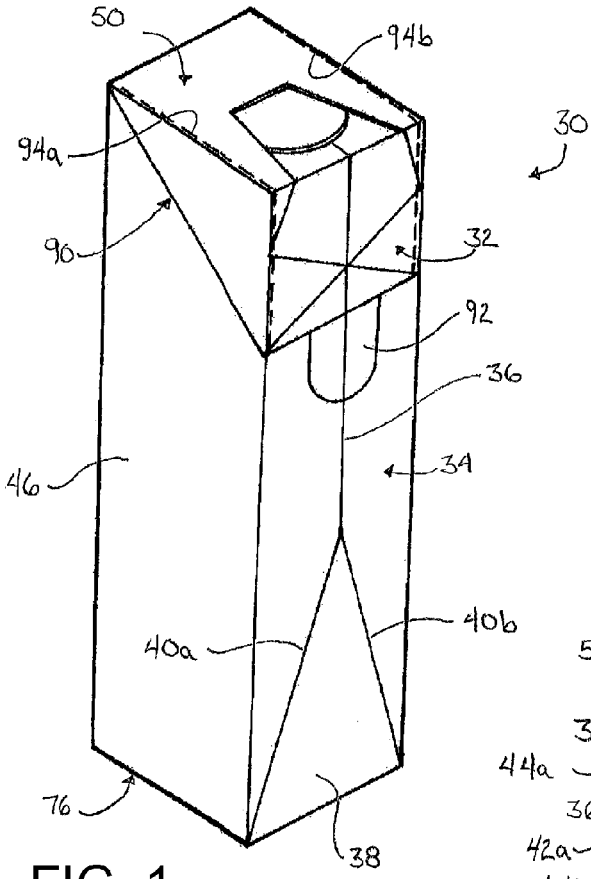
FIG. 1 is a front left side perspective view of a container in accordance with the present invention.

Referring now to FIG. 1, container 30 may include a tamper resistant seal, such as seal 90 shown in the illustrated embodiment. Seal 90 may be constructed of MYLAR or other such flexible foil or film product, and is intended to be placed on by the manufacturer after container 30 has been filled. Seal 90 includes a tab 92 and two rows of perforations 94*a*, 94*b* enabling seal 90 to be opened along perforations 94*a*, 94*b* by pulling of tab 92. Tab 92 may also include mastic to selectively fix tab 92 to main panel 34 such that seal 90 is able to more securely retain liquid products within container 30.

Figure 2:
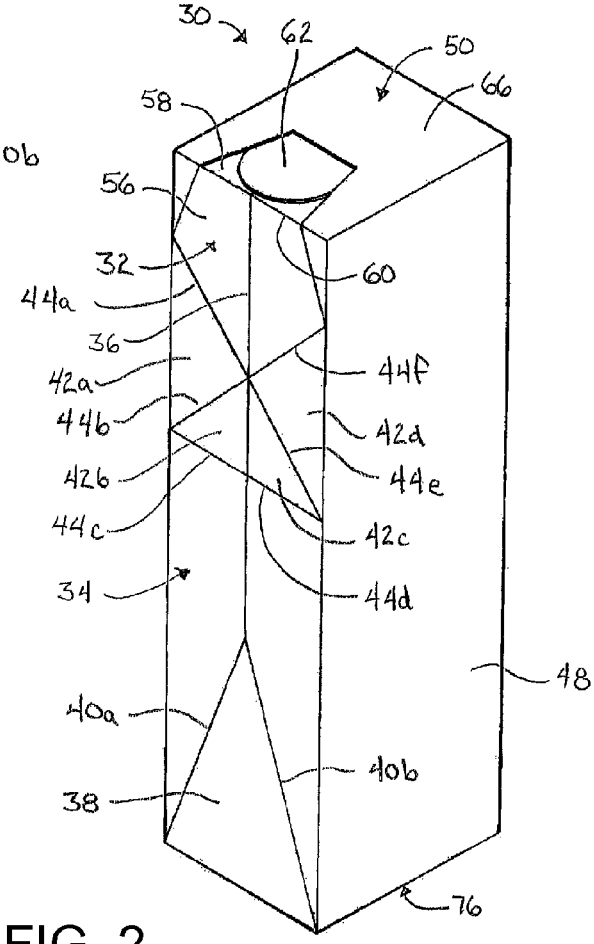
FIG. 2 is a front right side perspective view of the container of FIG. 1 shown with the seal removed for clarity.
Figure 3:
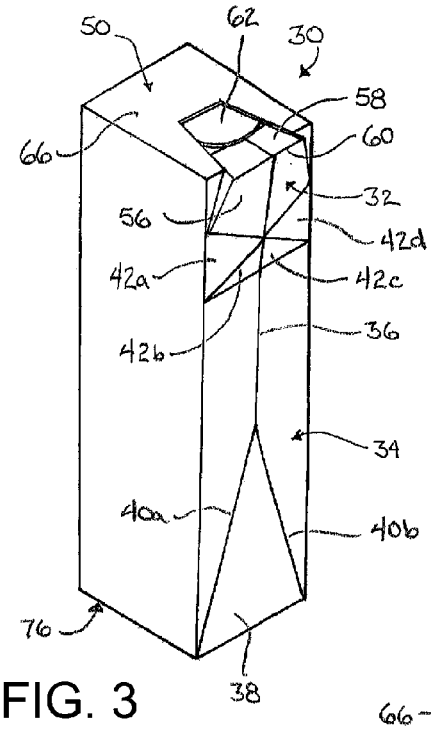
FIG. 3 is a front right side perspective view of the container of FIG. 2 shown with the spout initially opening.

From the fully closed position of FIG. 2, container 30 is opened by first inwardly depressing or deforming left side 46 and right side 48 toward each other in a squeezing manner, with the inward squeezing force being applied to sides 46, 48 proximate top side 50. This squeezing force causes main panel 34 to outwardly deform along pivot emboss 36, which in turn causes pivot emboss 36 to straighten along its entire length such that tuck flap 58 is both displaced from locking tab flap 62 (FIG. 3) and aligned with main flap 56 to straighten spout panel 32 (FIG. 4). Next, inward deformation applied to trigger panels 42, such as by depressing with a single finger at the intersection of trigger embosses 42*b* and 42*c*, causes spout panel 32 to be outwardly tilted or extended relative to main panel 34 into the fully opened position of FIG. 5.

Figure 7:
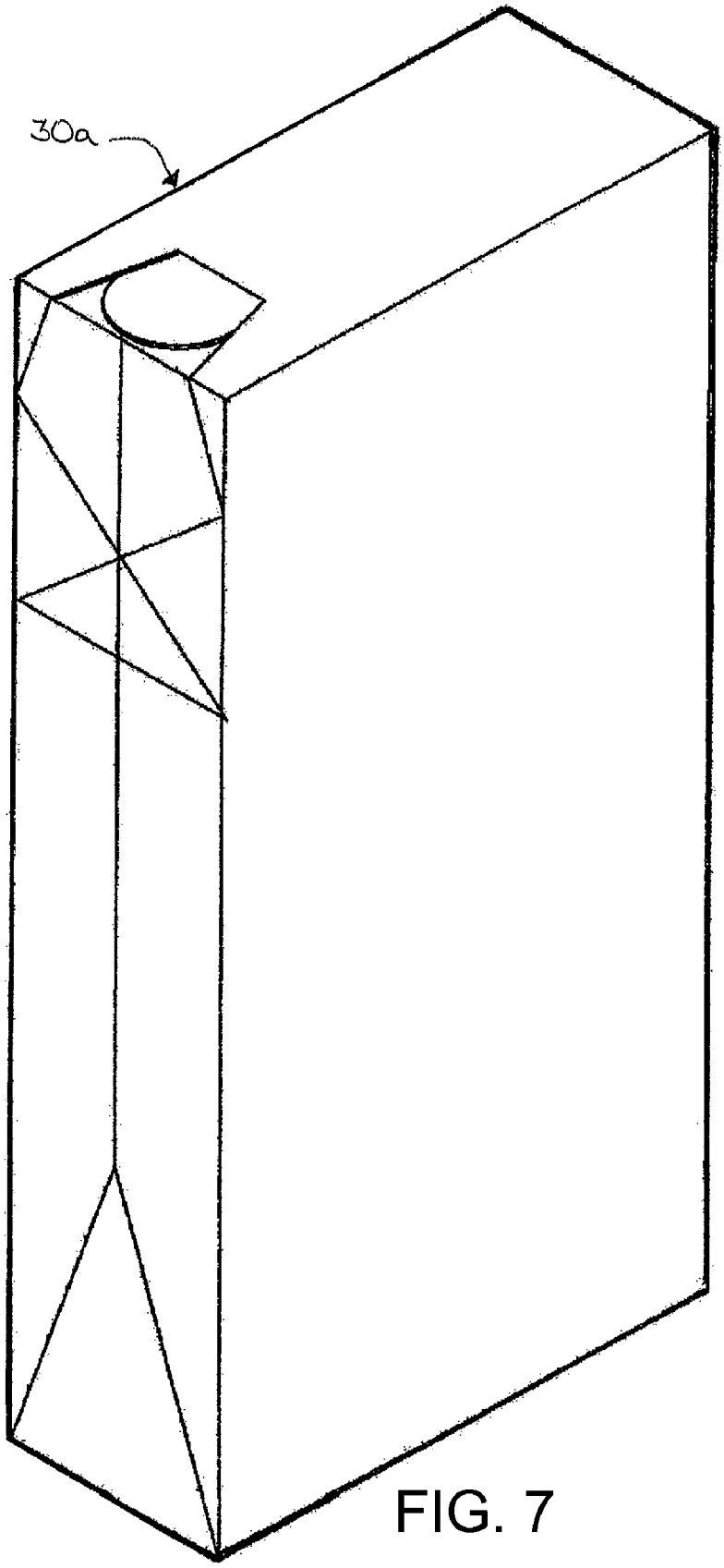
FIG. 7 is a front right side perspective view of an alternatively sized container in accordance with the present invention.

Alternative arrangements of container 30 may be constructed in accordance with the present invention. For example, alternatively sized containers may be constructed such as container 30*a* of FIG. 7, with container 30*a* being of substantially similar construction to container 30 but having differing overall width, height, and length sizes. An alternative container may also be formed wherein the main panel is formed on the top side. Still further, an alternative container may include trigger panels and/or pivot panels that are not triangular in shape. Such alternative trigger panels may, for example, be formed by curved trigger embosses.

Referring now to FIGS. 8-11, an alternative embodiment of the present invention is illustrated as container 130 that may be used with various products, including liquid products such as milk, with container 130 incorporating features of container 30 of FIGS. 1-6. As understood from FIG. 12, container 130 is formed as a stamped blank 152 that is subsequently folded into container 130 of FIGS. 8-11 and held in position by adhesive and various tuck panels, with the stamping process forming various cuts and embosses on blank. For ease of understanding, blank 152 of FIG. 12 illustrates the various emboss lines as dashes and the cutouts or cuts as solid lines.

Container 130 includes a front or main panel 134 having a longitudinally extending pivot emboss 136, and a pivot panel or inversion panel 138 defined by panel embosses 140*a*, 140*b* extending downwardly and outwardly from one end of pivot emboss 136 to respective corners of main panel 134. Spout or spout panel 132 is connected to main panel 134 and pivots relative thereto via edge fold emboss 188*a*, with pivot emboss 136 extending along spout panel 132. Spout panel 132 includes a main flap 156 and a tuck flap 158, with tuck flap 158 being able to pivot relative to main flap 156 along spout fold emboss 160. Spout panel 132 further includes a pair of guide flaps 161*a*, 161*b* on either side of spout panel 132, with guide flaps 167*a*, 167*b* configured to being folded inward of main flap 156 along guide flap embosses 163*a* and 163*b*, respectively.

Figure 8:
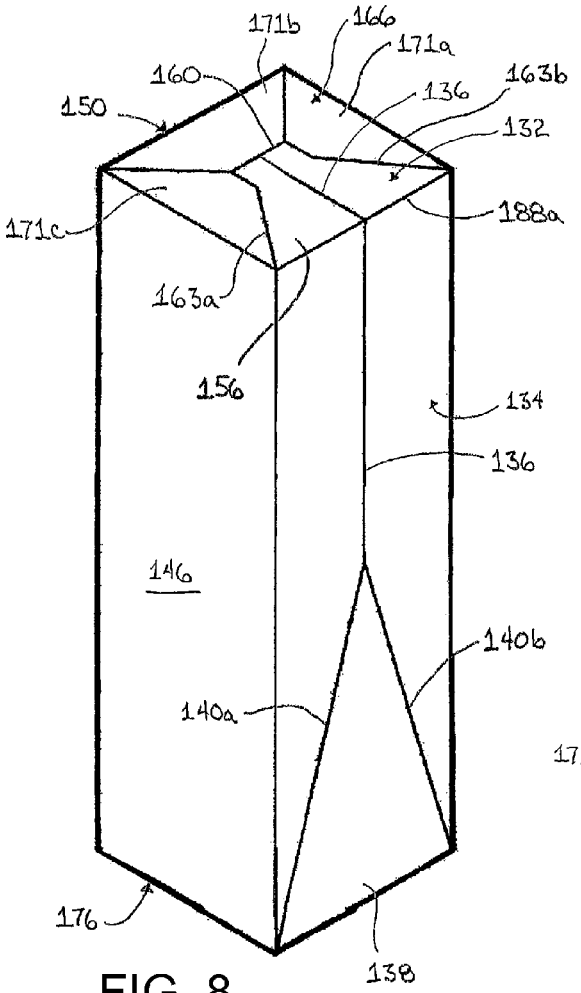
FIG. 8 is a front left side perspective view of an alternative container in accordance with the present invention.
Figure 9:
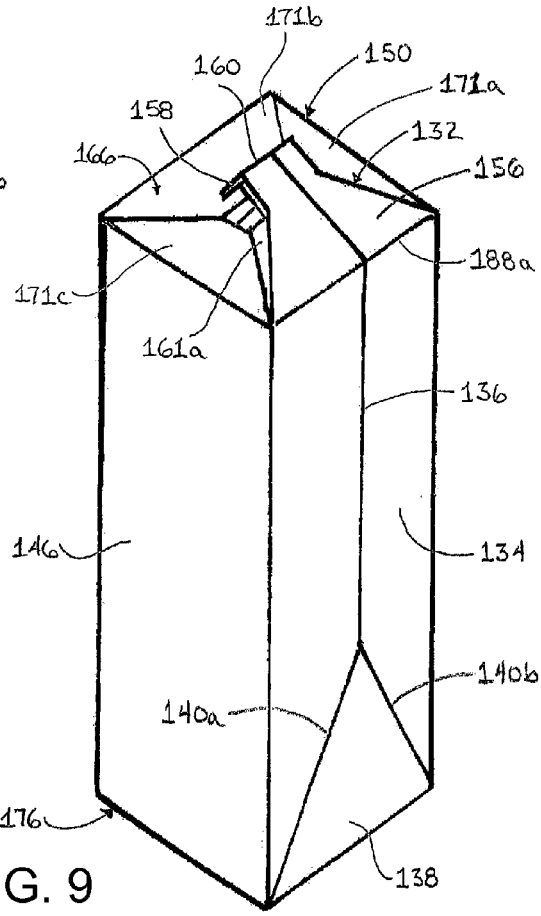
FIG. 9 is a front left side perspective view of the container of FIG. 8 shown with the spout initially opening.

Top side or closure side 150 of container 130 is formed by closure panel 166 and spout panel 132, with main flap 156 being orthogonal to main panel 134 when container 130 is in the closed position of FIG. 8. Closure panel 166 includes a retention tab 165 and a pair of guide tabs 167*a*, 167*b* on either side of opening 169 formed in closure panel 166. Closure panel 166 further includes three top pivot panels 171*a*, 171*b*, 171*c* formed by top pivot embosses 173*a*, 173*b*, 173*c*, 173*d* and top edge fold emboss 188*b*. When blank 152 is configured into container 130, retention tab 165 and guide tabs 167*a*, 167*b* are folded to be generally orthogonal to top pivot panels 171*a*, 171*b*, 171*c* by being folded inward along fold embosses 175*a*, 175*b*, 175*c*, respectively.

Figure 12:
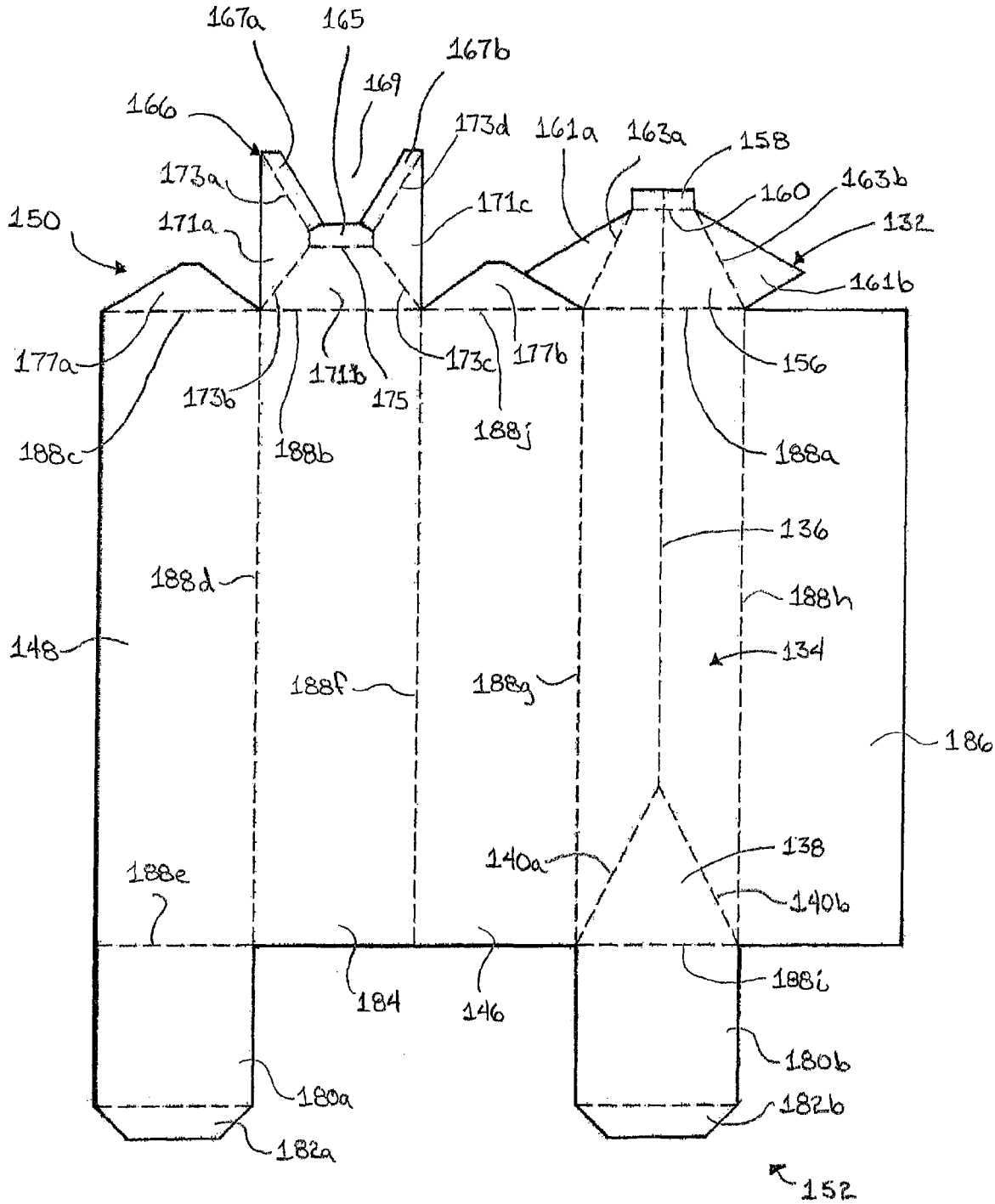
FIG. 12 is a top plan view of a stamped blank used to form the container of FIGS. 8-11.

Container 130 also includes a left side panel 146, a rear panel 184, and a right side panel 148 (FIG. 12). As shown in FIG. 12, blank 152 for container 130 further includes a pair of connecting tabs 177*a*, 177*b*, and a pair of bottom closure panels 180*a*, 180*b*, each of which includes a bottom tuck panel 182*a*, 182*b*, respectively. Blank 152 for container 130 further includes a glue flap 186 and various edge fold embosses 188*a*-188*j*; along which the panels and flaps are folded to construct container 130.

Assembly of container 130 from blank 152 involves adhering glue flap 186 to the interior side of right side flap 148. Bottom side 176 is then formed by overlapping the two bottom closure panels 180*a*, 180*b*, with the bottom tuck panel 182*b* of panel 180*b* being inserted behind the interior side of rear panel 184 and the bottom tuck panel 182*b* of panel 180*b* behind the interior side of left panel 146. Closure panel 166 is overlaid connecting tabs 177*a*, 177*b*, with connecting tab 177*a* adhered to the interior side of top pivot panel 171*a* and connecting tab 177*b* adhered to the interior side of top pivot panel 171*c*. Guide tabs 167*a*, 167*b* and retention tab 165 are folded inwardly of container 130 such that they each extend generally orthogonally relative to top pivot panels 171. In the fully closed position of FIG. 8, tuck flap 158 is folded along spout fold emboss 160 to be directed inwardly of container 130 and generally orthogonal relative to main flap 156. Guide flaps 161*a*, 161*b* are also folded inwardly such that they fit within opening 169 when spout panel 132 is in the closed position of FIG. 8.

Figure 10:
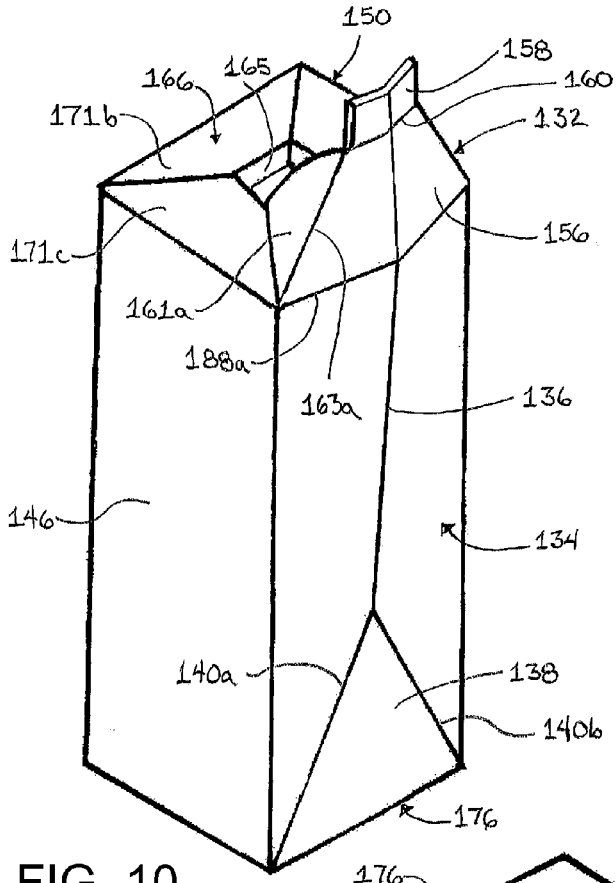
FIG. 10 is a front left side perspective view of the container of FIG. 8 shown with the spout fully opened.
Figure 11:
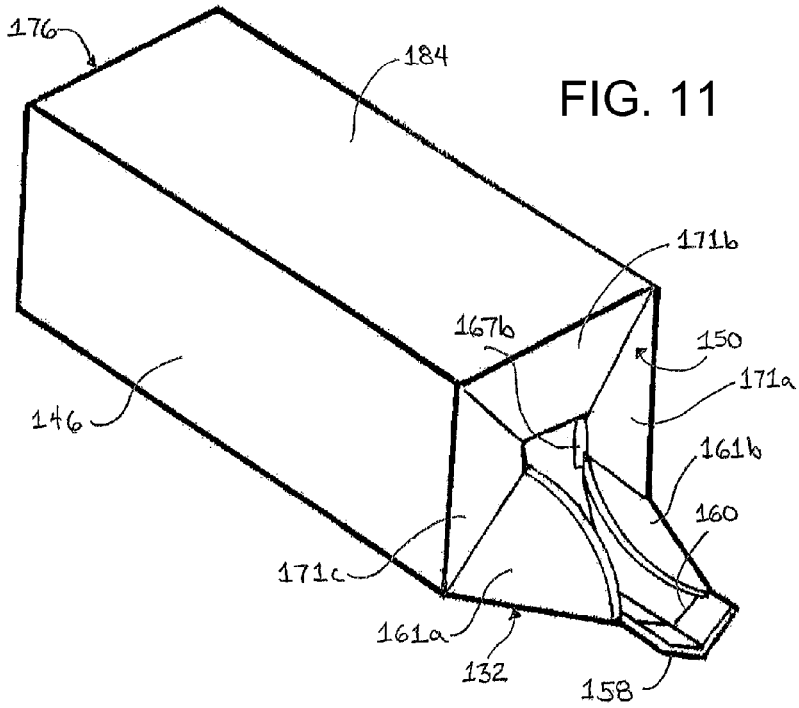
FIG. 11 is a perspective view of the container of FIG. 10 shown tipped for dispensing product contained within the container.

Container 130 is selectively opened by inward squeezing deformation of left side panel 146 and right side panel 148 proximate top side 150 and adjacent to edge fold emboss 188*a*. Inward squeezing deformation causes main panel 134 to outwardly deform along pivot emboss 136, thus causing pivot emboss 136 to straighten along its entire length which in turn causes tuck flap 158 to be initially displaced from contact with retention tab 165 (FIG. 9), and upon further squeezing to align tuck flap 158 with main flap 156 (FIGS. 10 and 11) to straighten spout panel 132. When fully extended as shown in FIGS. 10 and 11, spout panel 132 forms a convenient spout from which to dispense products contained within container 130 when container 130 is tilted, as shown in FIG. 11. A seal (not shown), such as that used with container 30 may optionally be employed with container 130 to keep spout panel 132 closed prior to opening by a user.

Figure 13:
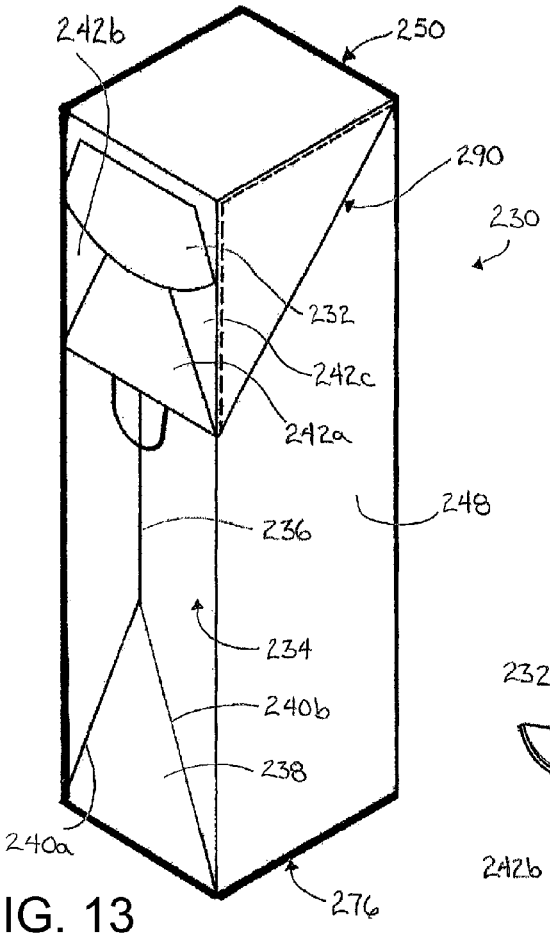
FIG. 13 is a front right side perspective view of another alternative container in accordance with the present invention.
Figure 14:
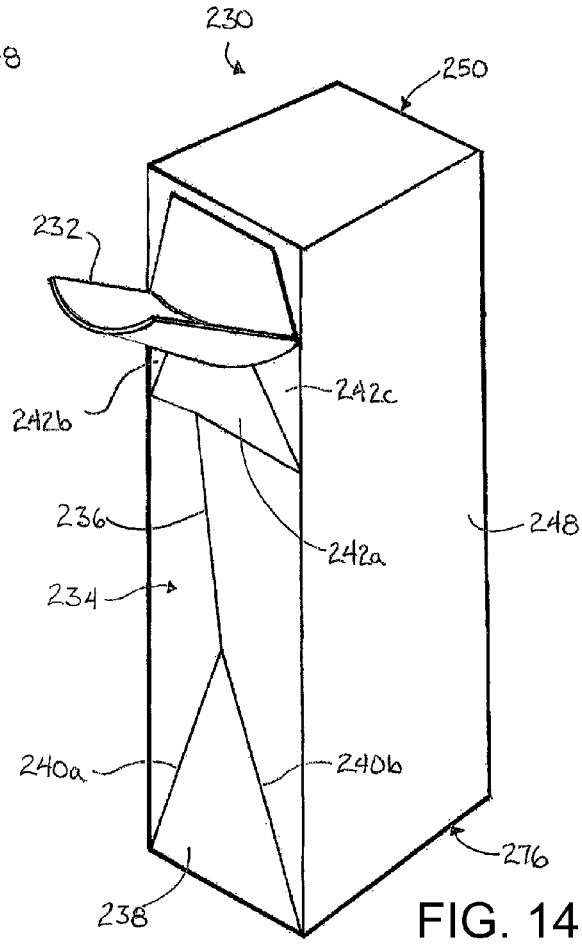
FIG. 14 is a front right side perspective view of the container of FIG. 13 shown with the seal removed and the spout fully opened.
Figure 15:
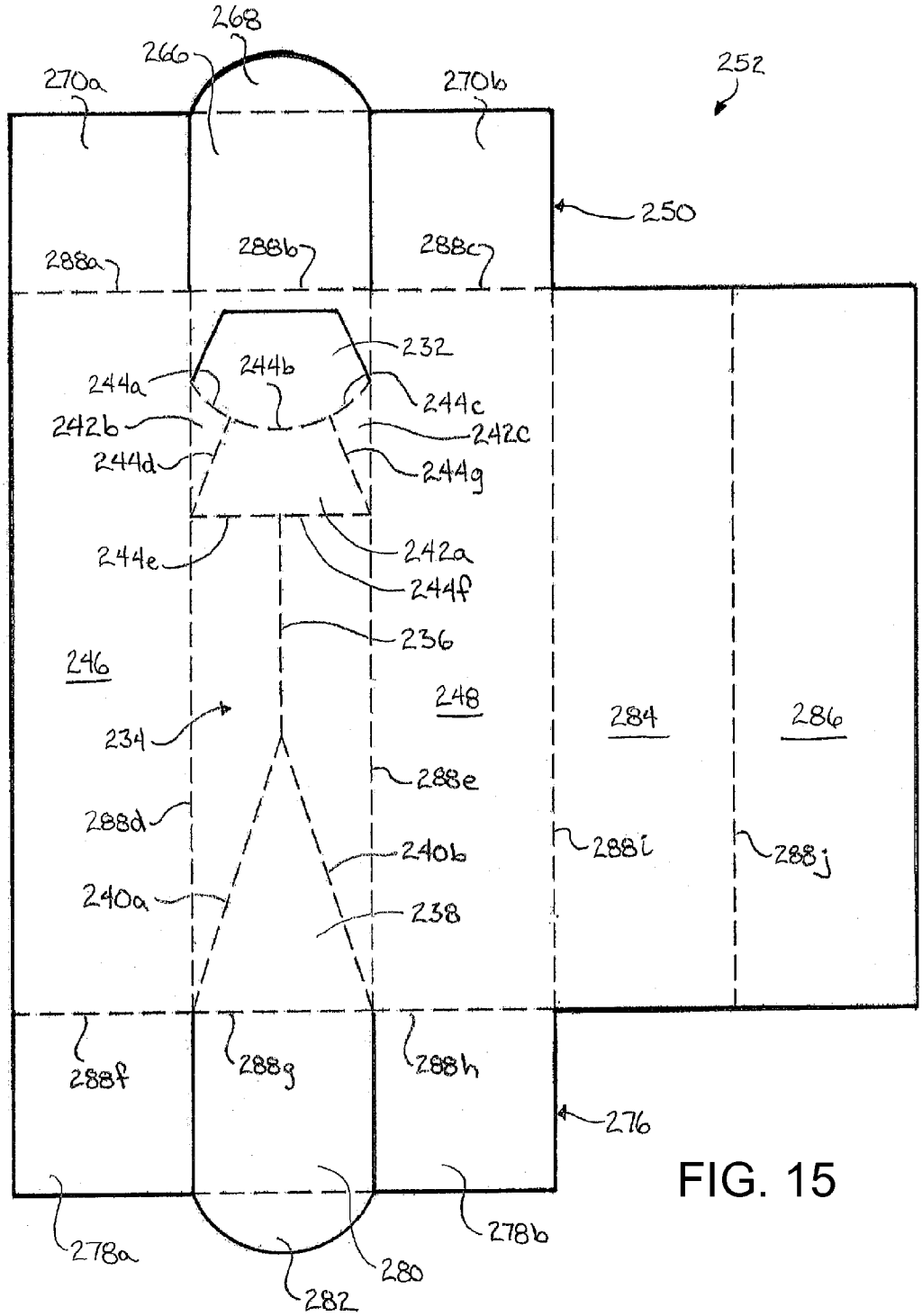
FIG. 15 is a top plan view of a stamped blank used to form the container of FIGS. 13-14.

Referring now to FIGS. 13-15, another alternative embodiment of the present invention is illustrated as container 230, with container 230 incorporating features of containers 30 and 130. As understood from FIG. 15, container 230 is formed as a stamped blank 252 that is subsequently folded into container 230 of FIGS. 13 and 14 and held in position by adhesive and various tuck panels, with the stamping process forming various cuts and embosses on blank 252. For ease of understanding, blank 252 of FIG. 15 illustrates the various emboss lines as dashes and the cutouts or cuts as solid lines.

Container 230 includes a main panel 234 having a longitudinally extending pivot emboss 236. Main panel 234 further includes a pivot panel or inversion panel 238 formed by panel embosses 240*a*, 240*b* extending downwardly and outwardly from one end of pivot emboss 236 to respective lower corners of main panel 234. Main panel 234 also includes a spout or spout panel 232, with the opposite end of pivot emboss 236 terminating at main panel 234. Spout panel 232 is formed entirely on main panel 234 such that in the closed position of FIG. 13 spout panel 232 and main panel 234 are substantially planar.

Main panel 234 further includes a central trigger panel 242*a* defined by trigger embosses 244*b*, 244*d*, 244*e*, 244*f* and 244*g*. A pair of secondary trigger panels 242*b*, 242*c* are positioned on either side of central trigger panel 242*a* as a result of the construction and placement of central trigger panel 242*a*. Secondary trigger panel 242*b* being defined by trigger embosses 244*a* and 244*d*, as well as edge fold emboss 288*d*. Secondary trigger panel 242*c* being defined by trigger embosses 244*c* and 244*g*, as well as edge fold emboss 288*e*. The bottom edge of spout panel 232 is thus defined by the trigger emboss segments 244*a*, 244*b*, and 244*c*, which comprise a single emboss 244.

As understood from FIG. 15, container 230 also includes a top side or closure side 250 that is formed by dust flaps 270*a*, 270*b*, as well as top closure panel 266 having top tuck panel 268. Bottom side 276 is formed by a pair of dust flaps 278*a*, 278*b*, as well as bottom closure panel 280 having bottom tuck panel 282. Container 230 further includes a rear panel 284, a glue flap 286, and edge fold embosses 288*a*-288*j*. Assembly of blank 252 into container 230 involves adhering glue panel 286 to the inside of left side panel 246. Bottom side 276 is assembled by first overlapping dust panels 278*a*, 278*b* with bottom closure panel 280 then being folded over dust panels 278*a*, 278*b* and bottom tuck panel 282 then being inserted behind the interior side of rear panel 284. Top side 250 is assembled by first overlapping dust flaps 270*a*, 270*b*, with top closure panel 266 then being folded over dust flaps 270*a*, 270*b* and top tuck panel 268 then being inserted behind the interior side of rear panel 284.

As shown in FIG. 13, container 230 may be provided with a seal 290 that is substantially similar to seal 90 of container 30. To open spout 232 of container 230 inward deformation of trigger panel 242*a* is applied, such as by pressing thereon with a finger, which in turn causes main panel 234 to inwardly deform along pivot emboss 236 and causes spout 232 to pivot into the open position illustrated in FIG. 14.

Figure 16:
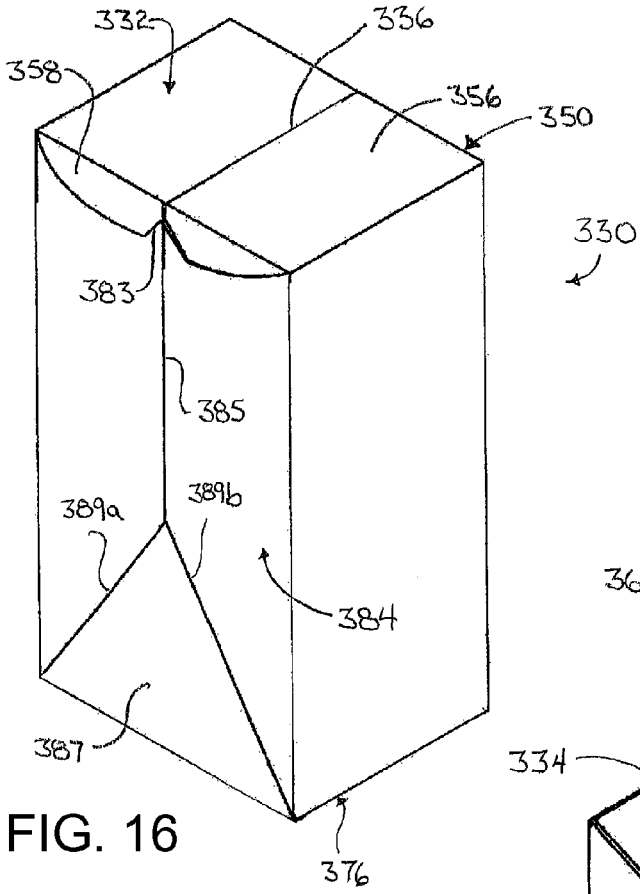
FIG. 16 is a back left side perspective view of another alternative container in accordance with the present invention.
Figure 17:
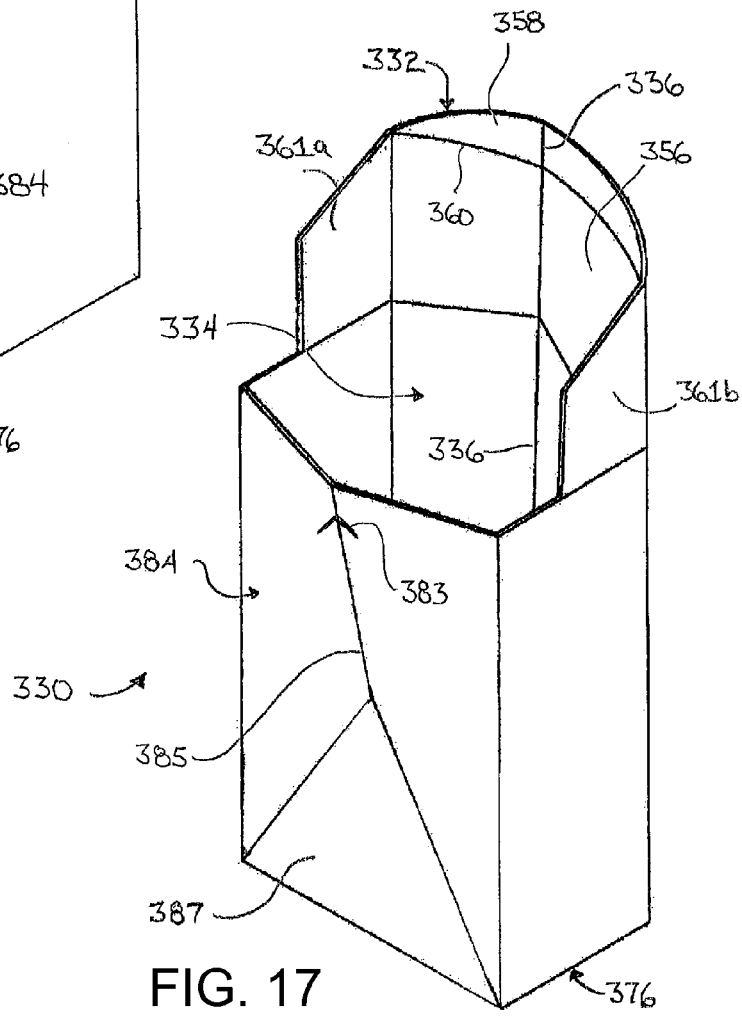
FIG. 17 is a back left side perspective view of the container of FIG. 16 shown with the spout fully opened.
Figure 18:
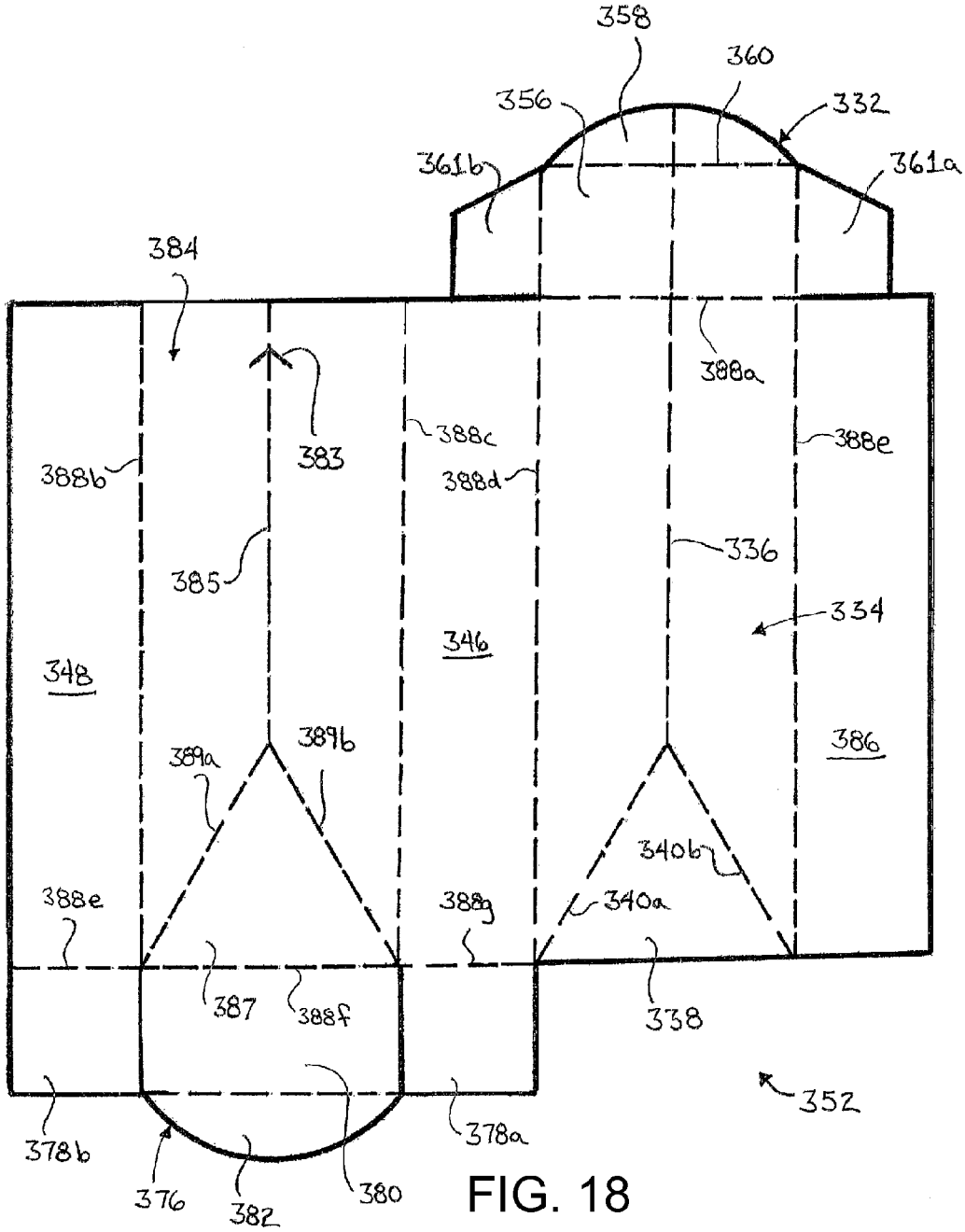
FIG. 18 is a top plan view of a stamped blank used to form the container of FIGS. 16-17.

Referring now to FIGS. 16-18, another alternative embodiment of the present invention is illustrated as container 330 that may be used for products such as soaps, bens, and coffee, with container 330 incorporating features of containers 30, 130 and 230. As understood from FIG. 18, container 330 is formed as a stamped blank 352 that is subsequently folded into container 330 of FIGS. 16 and 17 and held in position by adhesive and various tuck panels, with the stamping process forming various cuts and embosses on blank 352. For ease of understanding, blank 352 of FIG. 18 illustrates the various emboss lines as dashes and the cutouts or cuts as solid lines.

Container 330 includes a front or main panel 334 having a longitudinally extending pivot emboss 336. Main panel 334 further includes a pivot panel or inversion panel 338 formed by panel embosses 340*a*, 340*b* extending downwardly and outwardly from one end of pivot emboss 336 to respective lower corners of main panel 334. Spout or spout panel 332 is connected to main panel 334 at edge fold emboss 388*a*, with pivot emboss 336 extending along spout panel 332. Spout panel 332 includes a main flap 356 and a tuck flap 358 that fold relative to each other at spout fold emboss 360. Spout panel 332 further includes a pair of guide flaps 361*a*, 361*b* on either side of main flap 356, as well as edge fold embosses 388*a*-388*g* (FIG. 18).

Rear or back panel 384 of container 330 also includes a longitudinally extending back pivot emboss 385 and a back pivot panel or inversion panel 387 formed by back panel embosses 389*a*, 389*b* extending downwardly and outwardly from one end of back pivot emboss 385 to respective lower corners of back panel 384. A lock slit 383 is included on rear panel 384 for receiving tuck flap 358. Container 330 also includes a glue flap 386, left side panel 346, right side panel 348, and a bottom side 376. Bottom side 376 comprises a pair of dust flaps 378*a*, 378*b*, a bottom closure panel 380 and a tuck panel 382.

Container 330 is assembled by adhering glue flap 386 to the inside of right side panel 348. Bottom side 376 is assembled by first overlapping dust flaps 378*a*, 378*b* with bottom closure panel 380 then being folded over dust flaps 378*a*, 378*b* and bottom tuck panel 382 then being inserted behind the interior side of main panel 334. Spout panel 332 is folded over with guide flaps 361*a*, 361*b* inserted into the interior of container 330 and tuck flap 358 retained within lock slit 383. As such, spout panel 332 forms the top side 350 of container 330, with main flap 356 being substantially orthogonal to main panel 334 when in the closed position of FIG. 16.

Container 330 is selectively opened from the closed position of FIG. 16 by inward squeezing deformation of left side panel 346 and right side panel 348 proximate top side 384 and proximate back panel 384. This inward squeezing deformation initially causes back panel 384 to outwardly deform along back pivot emboss 385, which in turn causes tuck flap 358 to be released from lock slit 383. Continued inward squeezing of left side panel 346 and right side panel 348 further causes main panel 334 to outwardly deform along pivot emboss 336, which in turn causes tuck flap 358 and main flap 356 to align such that spout panel 332 is aligned with main panel 334 in the fully opened position of FIG. 17. When fully extended as shown in FIG. 17 spout panel 332 forms a convenient spout from which to dispense products contained within container 330 when container 330 is tilted. A seal (not shown), such as that used with container 30 may optionally be employed with container 330.

Figure 19:
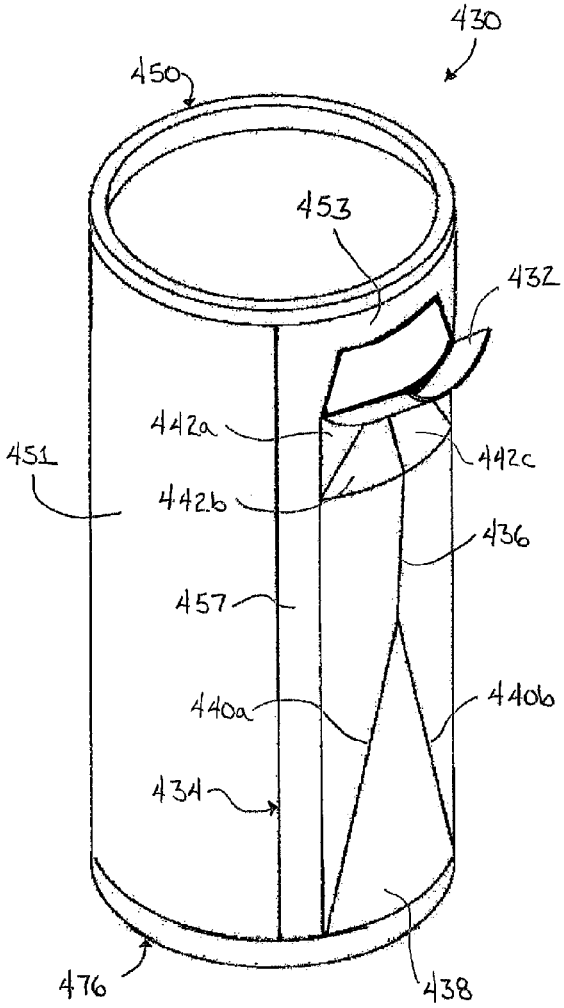
FIG. 19 is a side perspective view of an alternative container in accordance with the present invention shown with the spout fully opened.
Figure 20:
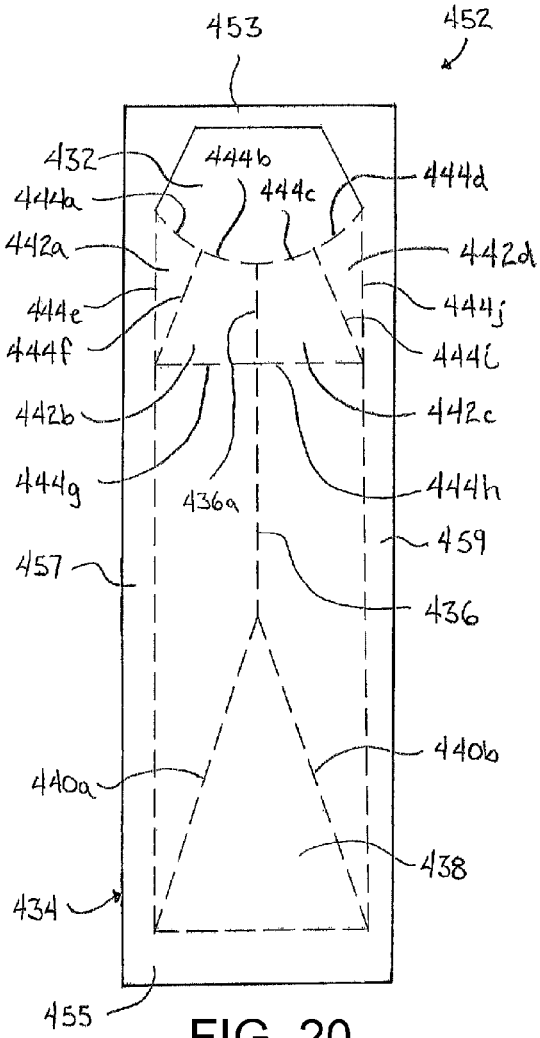
FIG. 20 is a top plan view of a stamped blank forming the main panel of the container of FIG. 19.

Referring now to FIGS. 19 and 20, another alternative embodiment of the present invention is illustrated as container 430, with container 430 incorporating features present in containers 30, 130, 230 and 330. In the illustrated embodiment container 430 represents a conventional 12 ounce beverage container and includes a top side 450 and a bottom side 476 affixed to a cylindrical wall portion 451 that is generally "C" shaped in cross section and to which main panel 434 is affixed.

As understood from FIG. 20, main panel 434 is formed as a stamped blank 452 and includes a top edge seal portion 453, a bottom edge seal portion 455 and side edge seal portions 457, 459. Main panel 434 is affixed to wall portion 451, such as by use of an adhesive applied to the back of main panel 434 along the various edge seal portions 453, 455, 457, 459. For ease of understanding, blank 452 of FIG. 20 illustrates the various emboss lines as dashes and the cutouts or cuts as solid lines that are created during the stamping process.

Main panel 434 includes a longitudinally extending pivot emboss 436, as well as a pivot panel or inversion panel 438 formed by panel embosses 440*a*, 440*b* extending downwardly and outwardly from one end of the pivot emboss 436 toward respective lower corners of main panel 434. Spout or spout panel 432 is formed entirely on main panel 434 such that when spout panel 432 is in the closed position (not shown) spout panel 432 and main panel 434 are substantially planar.

Main panel further includes four trigger panels 442*a*, 442*b*, 442*c*, and 442*d*. Trigger panel 442*a* is defined by trigger emboss 444*a*, 444*e*, and 444*f*. Trigger panel 442*b* is defined by trigger embosses 444*b*, 444*f*, and 444*g*, as well as a portion 436*a* of pivot emboss 436. Trigger panel 442*c* is defined by trigger embosses 444*c*, 444*i*, and 444*h*, and portion 436*a* of pivot emboss 436. Trigger panel 442*d* is defined by trigger embosses 444*d*, 444*j*, and 444*i*. Accordingly, bottom edge of spout panel 432 is defined by emboss segments 444*a*, 444*b*, and 444*c* of emboss 444.

Spout panel 432 is opened by pushing inward, such as by a finger, on trigger panels 442*b* and 442*c*, which in turn causes main panel 434 to inwardly deform along pivot emboss 436 and causes spout 432 to pivot into the open position illustrated in FIG. 19. A removable seal (not shown), such as a MYLAR seal applied with mastic, may be applied to container 430 over spout panel 432 to prevent unintended opening of spout panel 432. Although disclosed in connection with a 12 ounce beverage container, main panel 434 may be employed with other cylindrical containers, such as coffee cups. Still further, a blank (not shown) may be formed having a main panel similar to that of container 430, but which blank may be itself formed into a cylindrical container.

Various alternatives may be employed in the construction of containers within the scope of the present invention. For example, non-linear pivot panel and/or trigger embosses may be used, as well as non-triangular inversion panels. As noted, conventional adhesives for use in packaging products may be employed to construct sealed containers for use with liquids and/or powders. Containers of differing sizes and shapes that those illustrated may also be formed in accordance with the present invention, with such containers being useful for numerous types of products.

Containers 30, 130, 230, 330, and 430 provide uniformly shaped containers with integrated spouts that are easily opened, such as by squeezing the sides of the container to cause the spout to open and/or inwardly pressing on one or more trigger panels to cause the spout to open or fully open. The containers may be formed from a single blank sheet of packaging material that is subsequently folded into the container shape to include the integrated opening or spout.

Changes and modifications in the specifically described embodiments can be carried out without departing from the principles of the present invention which is intended to be limited only by the scope of the appended claims, as interpreted according to the principles of patent law including the doctrine of equivalents.

The embodiments in which I claim an exclusive property or privilege are defined as follows:

1. A dispensing container for selectively holding and dispensing products, said container comprising:

a resiliently deformable main panel, said main panel including a centrally disposed main panel pivot emboss extending longitudinally along said main panel;

a resiliently deformable back panel spaced from said main panel by at least two side panels; and a spout panel, said spout panel including a main flap, a tuck flap, and a spout panel pivot emboss extending across said main flap and said tuck flap, said main flap being connected to said main panel at a fold emboss and said tuck flap being connected to said main flap distally from said main panel with said main panel pivot emboss being aligned with said spout panel pivot emboss at said fold emboss, and with said main flap covering an opening of said container defined by said main panel, said back panel and said side panels when said spout panel is closed to define an entire side of said container with said tuck flap being positioned adjacent to and aligned with said back panel when said spout panel is closed;

said spout panel being at least partially selectively releasably opened by deformation of said side panels.

2. The container of claim 1, wherein said main panel is substantially planar when said dispensing container is closed, said main panel being connected with and positioned between said side panels with said side panels extending substantially orthogonally relative to said main panel and longitudinally relative to said pivot emboss.

3. The container of claim 2 further including a pivot panel on said main panel, said main panel pivot emboss terminating at said pivot panel at one end of said main panel pivot emboss, wherein said spout panel is at least partially opened by inward deformation of said side panels imparting deformation to said main panel along said main panel pivot emboss.

4. The container of claim 2, wherein said main panel is a vertically oriented panel and said side panels comprise a left side panel and a right side panel.

5. The container of claim 3, wherein said back panel includes a centrally disposed second pivot emboss extending longitudinally along said back panel, said back panel further including a second pivot panel, said second pivot emboss terminating at said second pivot panel at one end of said second pivot emboss;

and wherein said tuck flap is retained on said back panel when said container is closed and said tuck flap is displaced from said back panel by deformation of said back panel along said second pivot emboss.

6. The container of claim 3, wherein said pivot panel is defined on said main panel by a pair of pivot panel embosses, said pivot panel embosses extending from said pivot emboss.

7. The container of claim 1, wherein said container includes six sides, with said main panel defining one of said six sides, and wherein each said side is orthogonal to four adjacent said sides.

8. The dispensing container of claim 1 wherein said spout panel further includes a pair of guide flaps, said guide flaps being connected to said main flap at opposed edges of said main flap between said tuck flap and said first panel, and wherein said guide flaps extend generally orthogonally from said main flap into the interior of said container when said spout panel is closed.

9. A dispensing container for selectively holding and dispensing products, said container comprising:

a resiliently deformable main panel, said main panel including a centrally disposed pivot emboss extending longitudinally along said main panel with said main panel being substantially planar and vertically oriented when said dispensing container is closed;

a pair of side panels, said main panel being connected with and positioned between said side panels with said side panels extending substantially orthogonally relative to said main panel and longitudinally relative to said pivot emboss;

a top side, said top side being adjacent and orthogonal to said main panel and said side panels;

a spout panel, said spout panel being at least partially selectively opened by inward deformation of said side panels imparting deformation to said main panel along said pivot emboss; and a back panel, said back panel being spaced from said main panel by said side panels, and wherein said spout panel includes a main flap and a tuck flap, said main flap being connected to said main panel with said tuck flap retained on said back panel when said container is closed, and wherein said tuck flap is displaced from said back panel by inward deformation of said side panels.

10. The container of claim 9, wherein said main flap is orthogonal to said main panel when said container is closed whereby said main flap defines at least a portion of said top side.

11. The container of claim 9, further including a pivot panel on said main panel, said pivot emboss terminating at said pivot panel at one end of said pivot emboss.

12. The dispensing container of claim 9 wherein said spout panel further includes a pair of guide flaps, said guide flaps being connected to said main flap at opposed edges of said main flap between said tuck flap and said main panel, and wherein said guide flaps extend generally orthogonally from said main flap into the interior of said container when said spout panel is closed.

13. A dispensing container for selectively holding and dispensing products, said container comprising:

a resiliently deformable first panel;

a pair of side panels, said first panel being connected with and positioned between said side panels;

a resiliently deformable second panel, said second panel having a slit and being connected with and positioned between said side panels with said second panel being spaced from said first panel by said side panels; and a spout panel, said spout panel including a main flap, a tuck flap, and a spout panel pivot emboss extending across said main flap and said tuck flap, said main flap being connected to said first panel and said tuck flap being connected to said main flap distally from said first panel with said main flap and said tuck flap being connected at a fold emboss;

said main flap covering an opening defined by said first panel, said side panels and said second panel when said spout panel is closed, with said tuck flap being folded adjacent said second panel and retained within said slit;

said spout panel being at least partially selectively opened by inward deformation of said side panels with the inward deformation of said side panels causing said tuck flap to release from said slit.

14. The dispensing container of claim 13 wherein said main flap and said tuck flap of said spout panel are aligned with each other and with said first panel via inward deformation of said side panels when said spout panel is fully opened.

15. The dispensing container of claim 14 wherein said spout panel includes a single centrally positioned spout panel pivot emboss, said spout panel pivot emboss on said main flap extending between said first panel and said second panel when said spout panel is closed.

16. The dispensing container of claim 15 wherein said spout panel further includes a pair of guide flaps, said guide flaps being connected to said main flap at opposed edges of said main flap between said tuck flap and said first panel, and wherein said guide flaps extend generally orthogonally from said main flap into the interior of said container when said spout panel is closed.

17. The dispensing container of claim 14 wherein said container includes six sides with said main flap defining one of said six sides when said spout panel is closed, and wherein said side panels, said first panel and said second panel each define a separate one of said sides, and wherein each said side is orthogonal to four adjacent said sides when said spout panel is closed.

18. The dispensing container of claim 17 wherein said first panel includes a centrally disposed pivot emboss extending longitudinally along said first panel with said first panel being substantially planar and vertically oriented when said dispensing container is closed.

19. The dispensing container of claim 18 wherein said second panel includes a centrally disposed pivot emboss extending longitudinally along said second panel with said second panel being substantially planar and vertically oriented when said dispensing container is closed.

20. The dispensing container of claim 13 wherein said spout panel further includes a pair of guide flaps, said guide flaps being connected to said main flap at opposed edges of said main flap between said tuck flap and said first panel, and wherein said guide flaps extend generally orthogonally from said main flap into the interior of said container when said spout panel is closed.

* * * * *